US005941580A

United States Patent [19]

Takahashi

[11] Patent Number: 5,941,580

[45] Date of Patent: Aug. 24, 1999

[54] CLAMPING TYPE LOCK ASSEMBLY

[75] Inventor: Hiroyuki Takahashi, Tokyo, Japan

[73] Assignee: Takigen Manufacturing Co. Ltd., Tokyo, Japan

[21] Appl. No.: 08/846,292

[22] Filed: Apr. 30, 1997

[30] Foreign Application Priority Data

Jul. 29, 1996 [JP] Japan ..... 8-216012

[51] Int. Cl.[6] ..... E05C 5/00

[52] U.S. Cl. ..... 292/247; 292/DIG. 49

[58] Field of Search ..... 292/246–250, 292/256, 256.67, 256.69, 256.73, 256.75, DIG. 49, 247, 66, 71, 113

[56] References Cited

U.S. PATENT DOCUMENTS

| | | | |
|---|---|---|---|
| 493,456 | 3/1893 | Violet | 292/246 |
| 1,024,054 | 4/1912 | Barnes | 292/247 |
| 2,332,245 | 10/1943 | Moll | 292/256 |
| 3,998,481 | 12/1976 | Anthone | 292/256 |
| 4,035,009 | 7/1977 | Jacobs | 292/246 |
| 4,111,476 | 9/1978 | Jacobs | 292/246 |
| 5,129,537 | 7/1992 | Bordner | 292/256.69 |

*Primary Examiner*—Steven Meyers
*Assistant Examiner*—Gary Estremsky
*Attorney, Agent, or Firm*—Martin Smolowitz

[57] ABSTRACT

In the clamping type lock assembly, a base-end portion 2*a* of a latch ring 2 is pivoted to a fixed base plate 1. In a locked position in which a front-end portion 2*b* of the latch ring 2 engaged with an engaging concave portion 3*a* of an operating lever 3 passes through a straight line connecting a cross-sectional center of the base-end portion 2*a* of the latch ring 2 and a cross-sectional center of an axle pin 9 and approaches a fixed seating plate 4, a threaded shaft portion 5*b* of a fastening bolt 5 is threadably engaged with a threaded hole 21 of the fixed seating plate 4 so that a head portion 5*a* of the fastening bolt 5 is brought into press-contact with a front surface of a front-end portion of the operating lever 3.

6 Claims, 8 Drawing Sheets

CLAMPING TYPE LOCK ASSEMBLY

BACKGROUND OF THE INVENTION

1. Field of the Invention

The present invention relates to a clamping type lock assembly for locking a first clamped element to a second clamped element under the influence of a resilient force exerted by a latch member through which the first clamped element is engaged with the second clamped element.

2. Description of the Prior Art

In a conventional clamping type lock assembly, an operating lever has its base-end portion pivoted to a bearing plate portion of a base plate through an axle pin. The base plate is fixedly mounted on a first clamped element. A base-end portion of a latch member is pivoted to an intermediate portion of the operating lever. A receiving piece of the conventional lock assembly is fixedly mounted on a second clamped element. After a front-end portion of the latch member is engaged with the receiving piece in a condition in which the operating lever is pulled up, the operating lever is then pulled down to increase the tension of the latch member so that the first clamped element is fastened and locked to the second clamped element.

In this locked condition, a pivot point in the base-end portion of the latch member has already passed through a straight line, which connects a cross-sectional center of a front-end portion of the latch member and a cross-sectional center of the axle pin to form a boundary reference line for defining the locked condition, so that a return force due to a resilient deformation of the latch member acts on the operating lever as a torque for rotating the operating lever downward, whereby the operating lever is maintained in its locked position under the influence of such torque.

However, in the actual condition in application, for example such as in instrument boxes in railway service and the like, the operating lever is subjected to severe vibrations through the clamped elements, and, therefore floats off from a front surface of the clamped elements, which often permits the pivot point of the base-end portion of the latch member to pass through the above boundary reference line so as to further separate from the clamped elements, i.e., to unlock the lock assembly.

SUMMARY OF THE INVENTION

It is an object of the present invention to provide a clamping type lock assembly, which is free from a fear that the lock assembly is accidentally unlocked when subjected to vibration.

According to a first aspect of the present invention, the above object of the present invention is accomplished by providing:

a clamping type lock assembly comprising:

a fixed base plate fixedly mounted on a first clamped element, the fixed base plate being provided with a bearing plate portion in its front surface side;

a fixed seating plate fixedly mounted on a second clamped element, the fixed seating plate being provided with an axle-support plate portion in a front surface side of its base-end portion and also being provided with a pin-receiving plate portion in a rear surface side of its front-end portion, the pin-receiving plate portion being provided with a split groove portion;

an operating lever having its base-end portion pivoted to the axle-support plate portion of the fixed seating plate through an axle pin, the operating lever being provided with an engaging concave portion in a rear surface side of its intermediate portion and also being provided with a receiving groove portion in its front-end portion, the receiving groove portion opening at its front-end side;

a latch ring having its base-end portion pivoted to the bearing plate portion of the fixed base plate and its front-end portion engaged with the engaging concave portion of the operating lever;

a fastening pin rotatably inserted in the pin-receiving plate portion of the fixed seating plate, the fastening pin being provided with a threaded transverse hole in its intermediate portion; and a fastening bolt provided with a head portion and a threaded shaft portion following the head portion, the fastening bolt having the threaded shaft portion slidably inserted in the split groove portion of the fixed seating plate, the threaded shaft portion being threadably engaged with the threaded transverse hole of the fastening pin;

whereby, in a locked position in which the front-end portion of the latch ring engaged with the engaging concave portion of the operating lever passes through a straight line connecting a cross-sectional center of the base-end portion of the latch ring and a cross-sectional center of the axle pin and approaches the fixed seating plate, the threaded shaft portion of the fastening bolt is inserted into the receiving groove portion of the operating lever so that the head portion of the fastening bolt is brought into press-contact with a front surface of the front-end portion of the operating lever.

According to a second aspect of the present invention, the above object of the present invention is accomplished by providing:

a clamping type lock assembly comprising:

a fixed base plate fixedly mounted on a first clamped element, the fixed base plate being provided with a bearing plate portion in its front surface side;

a fixed seating plate fixedly mounted on a second clamped element, the fixed seating plate being provided with an axle-support plate portion in a front surface side of its base-end portion and also being provided with a threaded hole in its front-end portion;

an operating lever having its base-end portion pivoted to the axle-support plate portion of the fixed seating plate through an axle pin, the operating lever being provided with an engaging concave portion in a rear surface side of its intermediate portion and also being provided with a receiving hole portion in its front-end portion;

a latch ring having its base-end portion pivoted to the bearing plate portion of the fixed base plate and its front-end portion engaged with the engaging concave portion of the operating lever; and a fastening bolt provided with a head portion and a threaded shaft portion following the head portion, the fastening bolt having the threaded shaft portion slidably inserted in the receiving hole portion of the operating lever;

whereby, in a locked position in which the front-end portion of the latch ring engaged with the engaging concave portion of the operating lever passes through a straight line connecting a cross-sectional center of the base-end portion of the latch ring and a cross-sectional center of the axle pin and approaches the fixed seating plate, the threaded shaft portion of the fastening bolt is threadably engaged with the threaded hole of the fixed seating plate so that the head portion of the fastening bolt is brought into press-contact with a front surface of the front-end portion of the operating lever.

DESCRIPTION OF THE PREFERRED EMBODIMENTS

Figure 1:
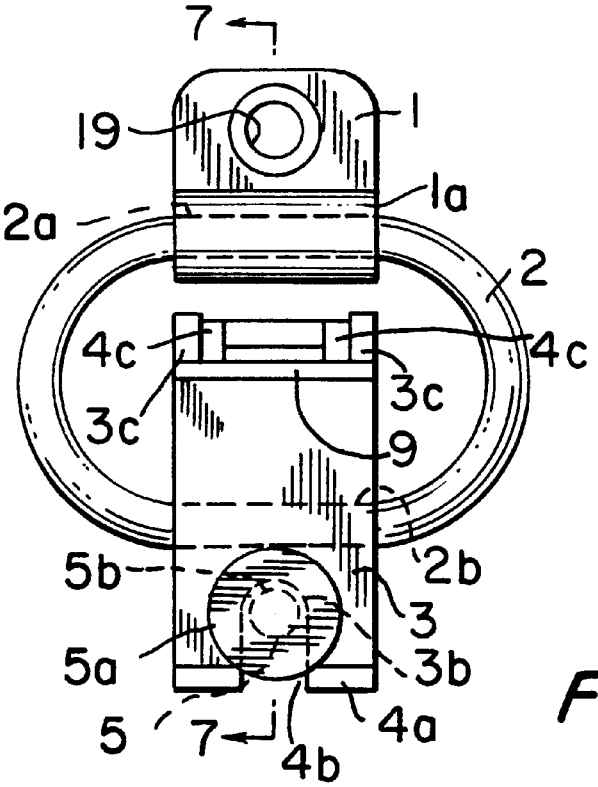
FIG. 1 is a front view of a first embodiment of the clamping type lock assembly of the present invention.

Hereinbelow, the present invention will be described in detail with reference to the accompanying drawings.

As shown in FIGS. 1 to 8, a clamping type lock assembly of a first embodiment of the present invention comprises: a fixed base plate 1 fixedly mounted on a first clamped element 8, the fixed base plate 1 being provided with a bearing plate portion la in its front surface side; a fixed seating plate 4 fixedly mounted on a second clamped element 10, the fixed seating plate 4 being provided with an axle-support plate portion 4*c* in a front surface side of its base-end portion and also being provided with a pin-receiving plate portion 4*a* in a rear surface side of its front-end portion, the pin-receiving plate portion 4*a* being provided with a split groove portion 4*b*; an operating lever 3 having its base-end portion pivoted to the axle-support plate portion 4*c* of the fixed seating plate 4 through an axle pin 9, the operating lever 3 being provided with an engaging concave portion 3*a* in a rear surface side of its intermediate portion and also being provided with a receiving groove portion 3*b* in its front-end portion, the receiving groove portion 3*b* opening at its front-end side; a latch ring 2 having its base-end portion 2*a* pivoted to the bearing plate portion 1*a* of the fixed base plate 1 and its front-end portion 2*b* engaged with the engaging concave portion 3*a* of the operating lever 3; a fastening pin 6 rotatably inserted in the pin-receiving plate portion 4*a* of the fixed seating plate 4, the fastening pin 6 being provided with a threaded transverse hole 6*a* in its intermediate portion; and, a fastening bolt 5 provided with a head portion 5*a* and a threaded shaft portion 5*b* following the head portion 5*a*, the fastening bolt 5 having the threaded shaft portion 5*b* slidably inserted in the split groove portion 4*b* of the fixed seating plate 4, the threaded shaft portion 5*b* being threadably engaged with the threaded transverse hole 6*a* of the fastening pin 6.

In a condition in which the operating lever 3 is pulled forward in front of the second clamped element 10, the front-end portion 2*b* of the latch ring 2 is engaged with the engaging concave portion 3*a* of the operating lever 3. After that, the operating lever 3 is rotated on the axle pin 9 so as to be depressed toward a front surface of the second clamped element 10. When the operating lever 3 has a rear surface of its intermediate portion brought into contact with the front surface of the second clamped element 10, the front-end portion 2*b* of the latch ring 2 passes through the straight line (hereinafter referred to as the locked-condition defining reference line) connecting a cross-sectional center of the base-end portion 2*a* of the latch ring 2 and a cross-sectional center of the axle pin 9, and approaches the fixed seating plate 4.

In this locked position, the fastening bolt 5 is swung forward on the fastening pin 6 mounted in the pin-receiving plate portion 4*a* of the fixed seating plate 4, and has its threaded shaft portion 5*b* inserted into the receiving groove portion 3*b* of the operating lever 5. Then, the fastening bolt 5 is rotated to have its threaded shaft portion 5*a* threadably engaged with the threaded hole 6*a* of the fastening pin 6, so that the head portion 5*a* of the fastening bolt 5 is brought into press-contact with a front surface of a front-end portion of the operating lever 3, whereby the operating lever 3 is prevented from floating off from the front surface of the second clamped element 10 even when subjected to vibration in use.

On the other hand, as shown in FIGS. 9 to 16, a clamping type lock assembly of a second embodiment of the present invention comprises: a fixed base plate 1 fixedly mounted on a first clamped element 8, the fixed base plate 1 being provided with a bearing plate portion 1*a* in its front surface side; a fixed seating plate 4 fixedly mounted on a second clamped element 10, the fixed seating plate 4 being provided with an axle-support plate portion 4*c* in a front surface side of its base-end portion and also being provided with a threaded hole 21 in its front-end portion 4*d*; an operating lever 3 having its base-end portion pivoted to the axle-support plate portion 4*c* of the fixed seating plate 4 through an axle pin 9, the operating lever 3 being provided with an engaging concave portion 3*a* in a rear surface side of its intermediate portion and also being provided with a receiving hole portion 3*d* in its front-end portion; a latch ring 2 having its base-end portion 2*a* pivoted to the bearing plate portion 1*a* of the fixed base plate 1 and its front-end portion 2*b* engaged with the engaging concave portion 3*a* of the operating lever 3; and, a fastening bolt 6 provided with a head portion 5*a* and a threaded shaft portion 5*b* following the head portion 5*a*, the fastening bolt 5 having the threaded shaft portion 5*b* slidably inserted in the receiving hole portion 3*d* of the operating lever 3.

In a condition in which the operating lever 3 is pulled forward in front of the second clamped element 10, the front-end portion 2*b* of the latch ring 2 is engaged with the engaging concave portion 3*a* of the operating lever 3. After that, the operating lever 3 is rotated on the axle pin 9 so as to be depressed toward a front surface of the second clamped element 10. When the operating lever 3 has a rear surface of its intermediate portion brought into contact with the front surface of the second clamped element 10, the front-end portion 2*b* of the latch ring 2 passes through the straight line, i.e., locked-condition defining reference line connecting a cross-sectional center of the base-end portion 2*a* of the latch ring 2 and a cross-sectional center of the axle pin 9, and approaches the fixed seating plate 4.

In this locked position, the threaded shaft portion 5*b* of the fastening bolt 5 is threadably engaged with the threaded hole 21 of the fixed seating plate 4 so that the head portion 5*a* of the fastening bolt 5 is brought into press-contact with a front surface of a front-end portion of the operating lever 3, whereby the operating lever 3 is prevented from floating off from the front surface of the second clamped element 10 even when subjected to vibration in use.

Figure 2:
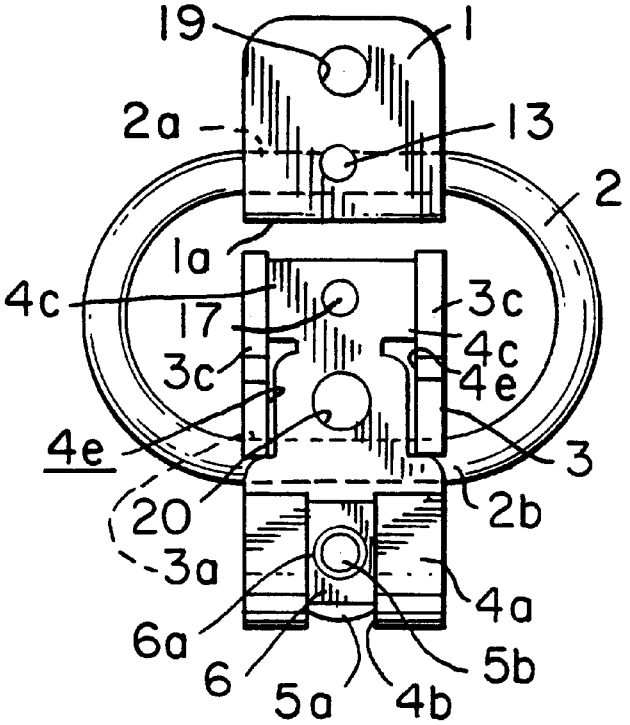
FIG. 2 is a rear view of the clamping type lock assembly shown in FIG. 1.
Figure 3:
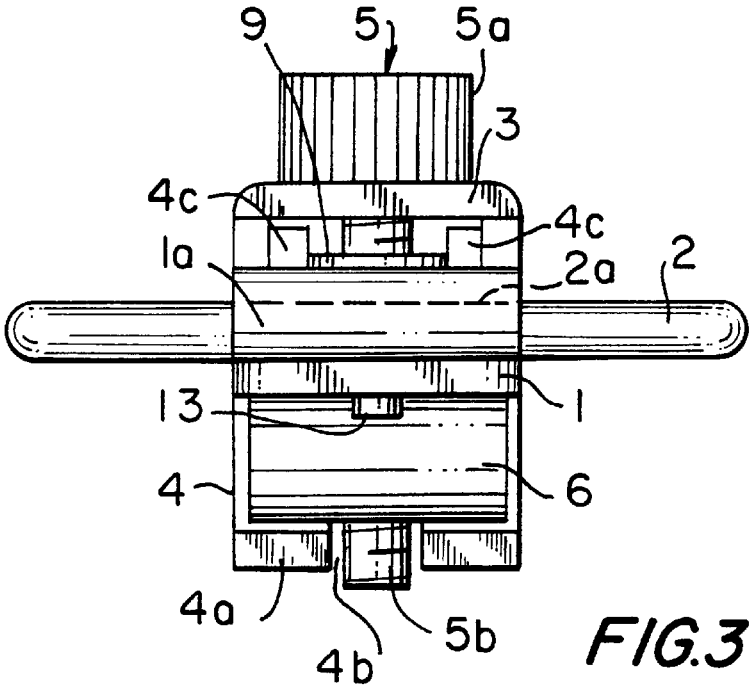
FIG. 3 is a plan view of the clamping type lock assembly shown in FIG. 1.
Figure 4:
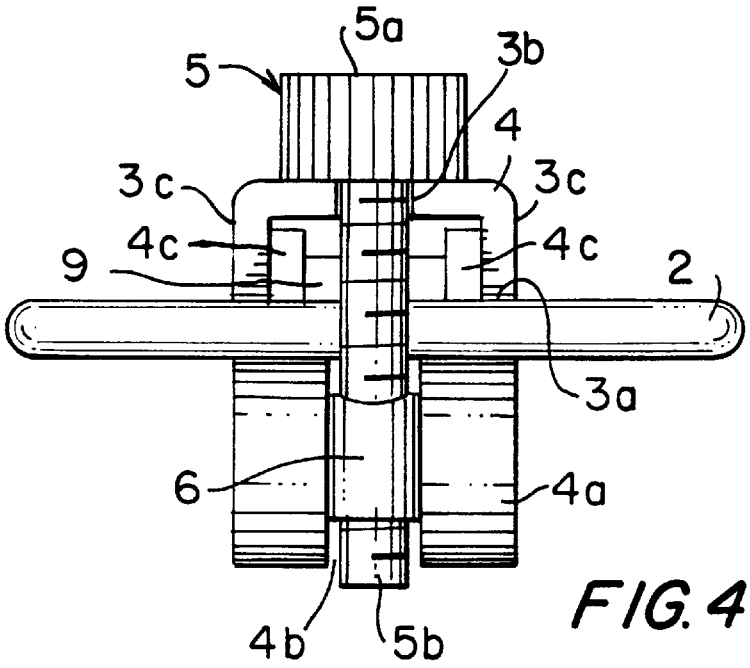
FIG. 4 is a bottom view of the clamping type lock assembly shown in FIG. 1.
Figure 5:
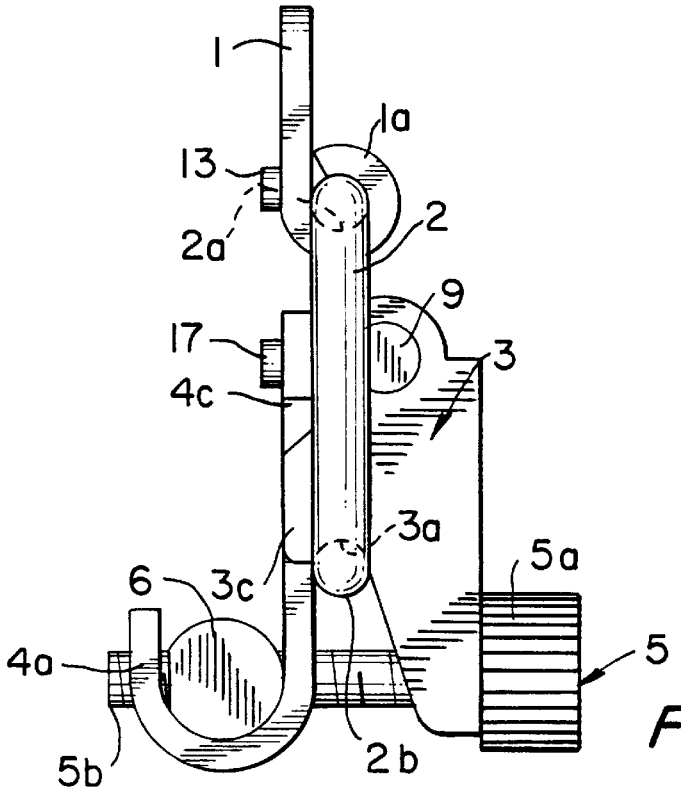
FIG. 5 is a left side view of the clamping type lock assembly shown in FIG. 1.
Figure 6:
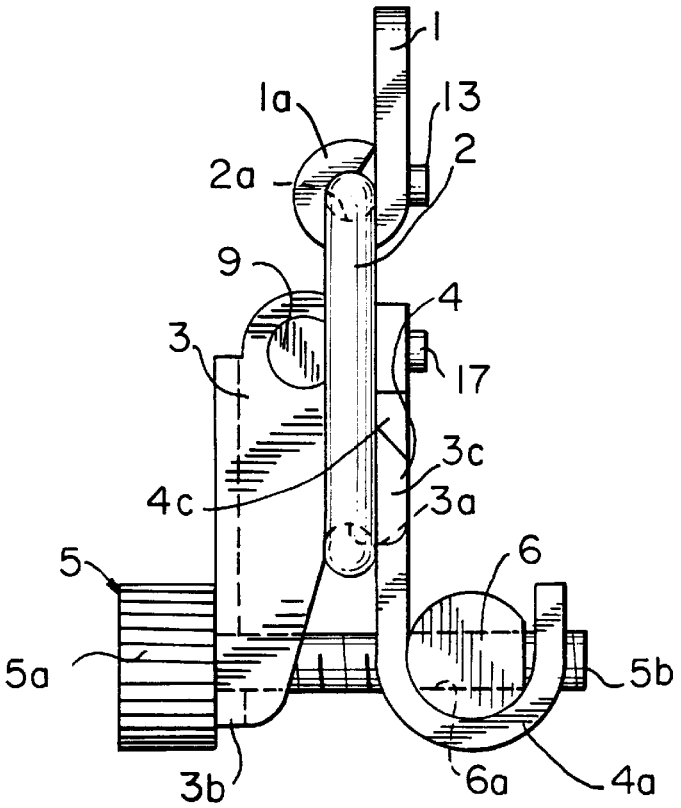
FIG. 6 is a right side view of the clamping type lock assembly shown in FIG. 1.
Figure 7:
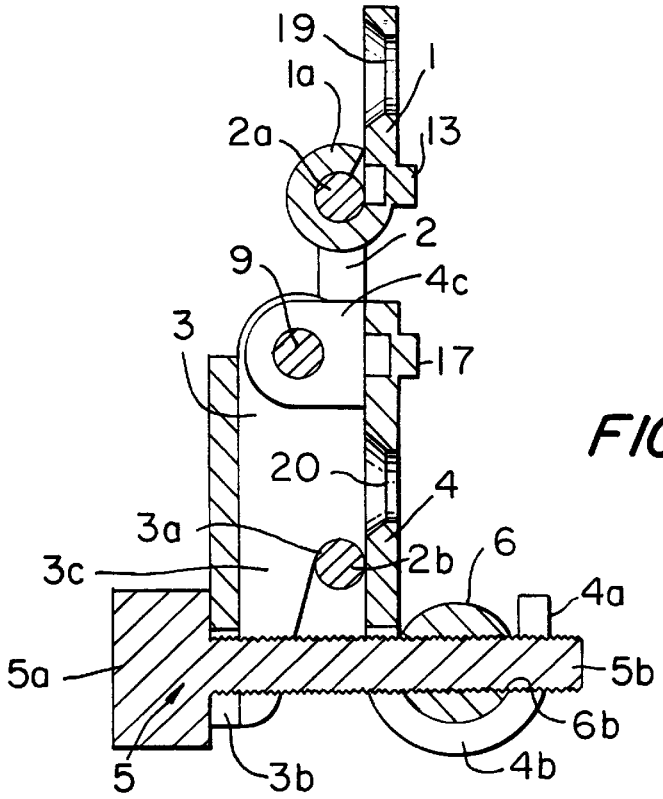
FIG. 7 is a sectional view of the clamping type lock assembly of the present invention, taken along the line 7—7 of FIG. 1.
Figure 8:
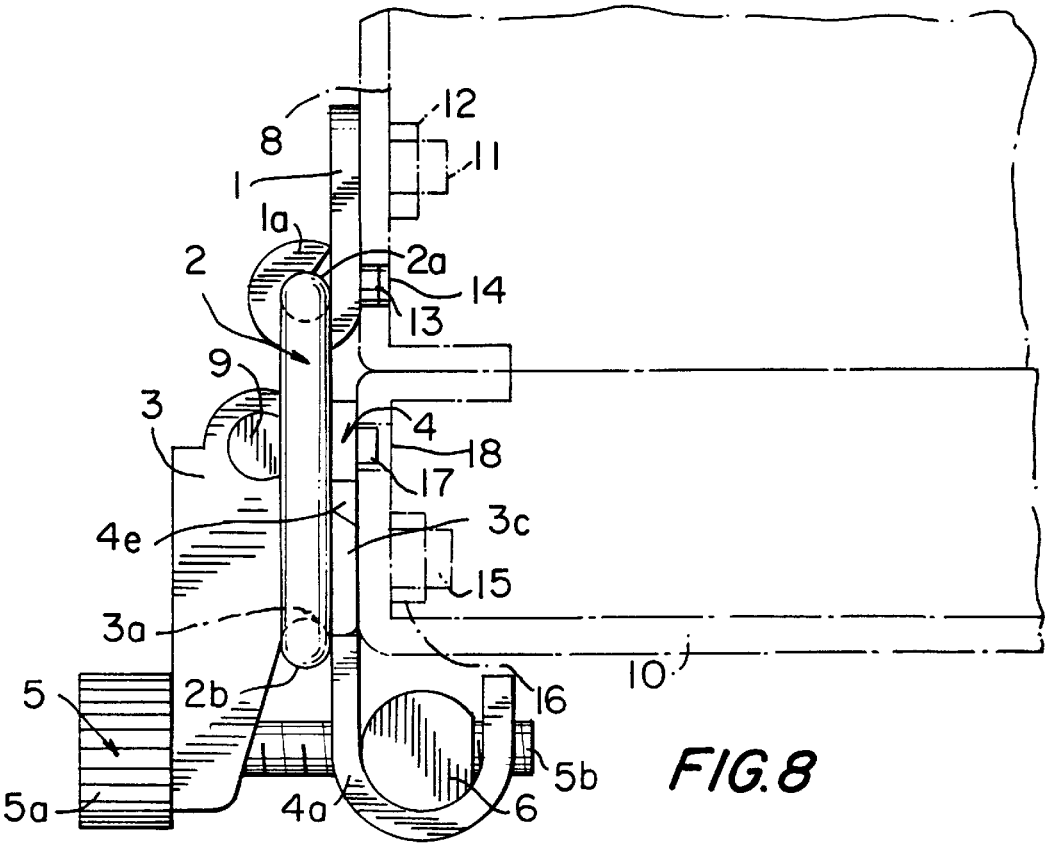
FIG. 8 is a right side view of the clamping type lock assembly shown in FIG. 1 in use.
Figure 9:
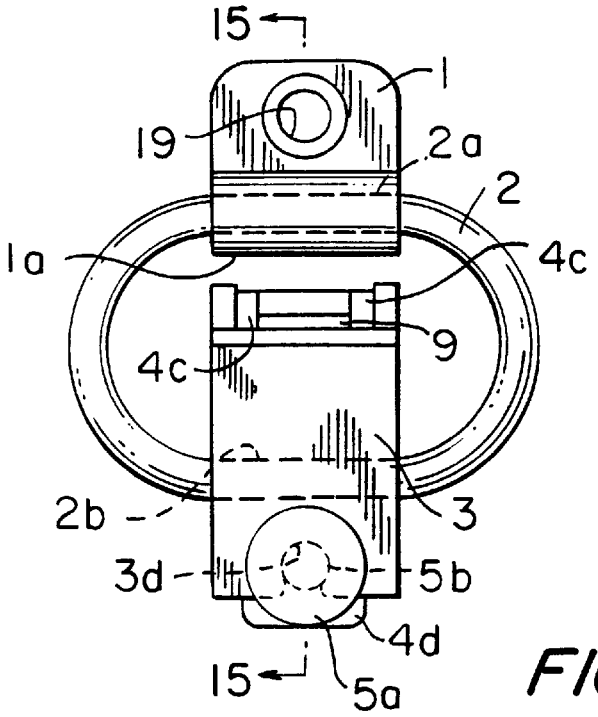
FIG. 9 a front view of a second embodiment of the clamping type lock assembly of the present invention.

On the other hand, in the first embodiment of the clamping type lock assembly of the present invention shown in FIGS. 1 to 8, the bearing plate portion 1*a* of the fixed base plate 1 is formed into a sleeve-like shape as is clear from FIG. 7. Provided in a rear surface side of the bearing plate portion 1*a* is a projection 13 which prevents the fixed base plate 1 from rotating on its mounting hole 19. In mounting, the projection 13 of the fixed base plate 1 is inserted into a rotation prevention hole 14 of the first clamped element 8. Then, a screw 11 is inserted into the mounting hole 19 of the fixed base plate 1 and threadably engaged with a nut 12 disposed in a rear side of the first clamped element 8, so that the fixed base plate 1 is fixedly mounted on the first clamped element 8. As shown in FIG. 4, the fixed seating plate 4 has a pair of its axle-support plate portions 4*c* arranged side by side, and is provided with a rotation prevention projection 17 in its rear surface, as shown in FIG. 7. The rotation prevention projection 17 of the fixed seating plate 4 is inserted into a rotation prevention hole 18 of the second clamped element 10. After that, a screw 15 is inserted into a mounting hole 20 of the fixed seating plate 4 and threadably engaged with a nut 16 disposed in a rear side of the second clamped element 10, so that the fixed seating plate 4 is fixedly mounted on the second clamped element 10. The fixed seating plate 4 has its pin-receiving portion 4*a* formed into a substantially U-shaped form in cross-section, as is clear from FIG. 8. The pin-receiving portion 4*a* opens at its upper side. As shown in FIG. 2, the fixed seating plate 4 is provided with a pair of notched portions 4*e* in opposite sides of its main-body portion to receive opposite wall plate portions 3*c* of the operating lever 3 in these notched portions 4*e*, which makes it possible to minimize the entire height of the clamping type lock assembly of the present invention, and, therefore to realize maximum compactness of the lock assembly of the present invention.

Figure 10:
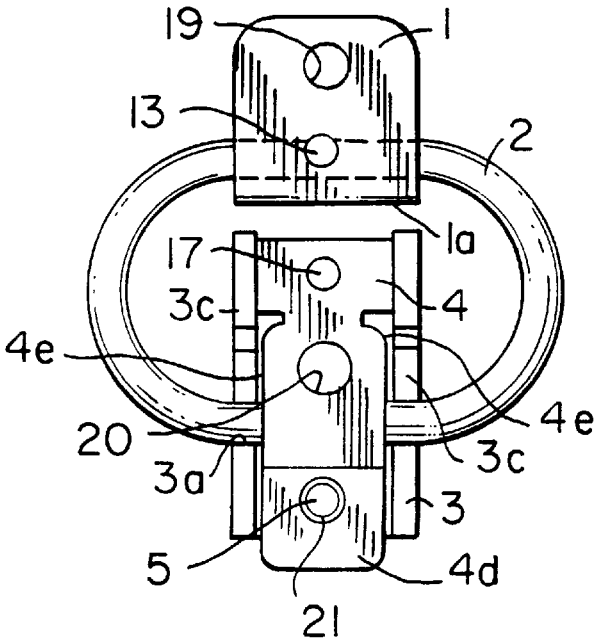
FIG. 10 is a rear view of the clamping type lock assembly shown in FIG. 9.
Figure 11:
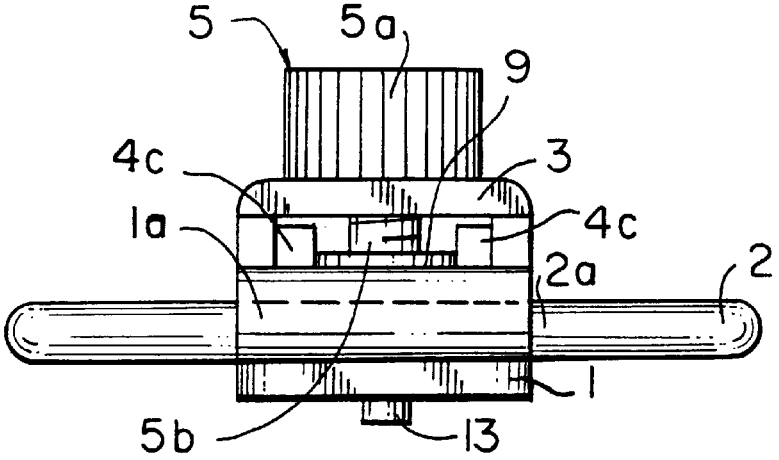
FIG. 11 is a plan view of the clamping type lock assembly shown FIG. 9.
Figure 12:
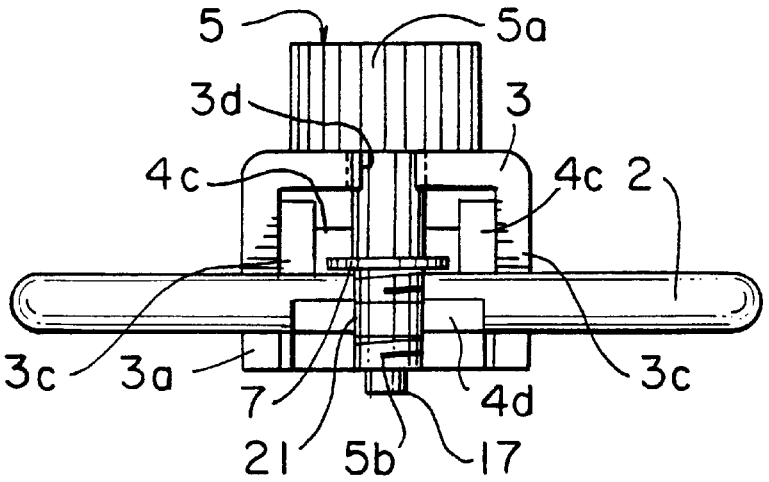
FIG. 12 is a bottom view of the clamping type lock assembly shown in FIG. 9.
Figure 13:
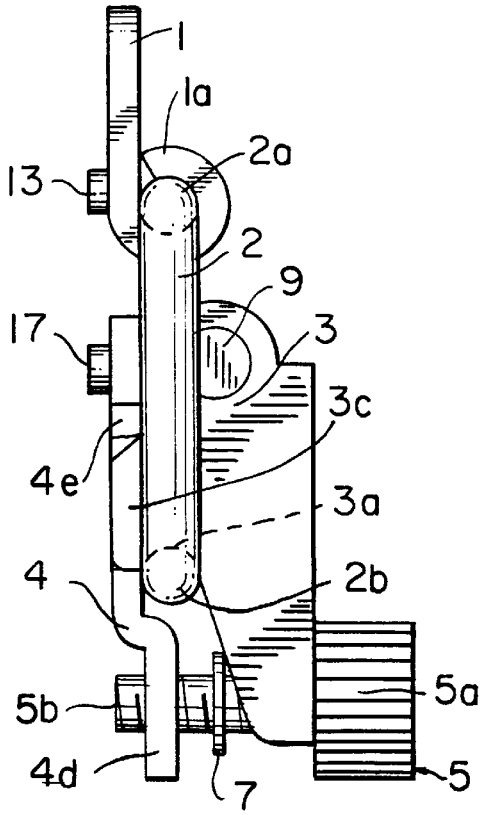
FIG. 13 is a left side view of the clamping type lock assembly n in FIG. 9.
Figure 14:
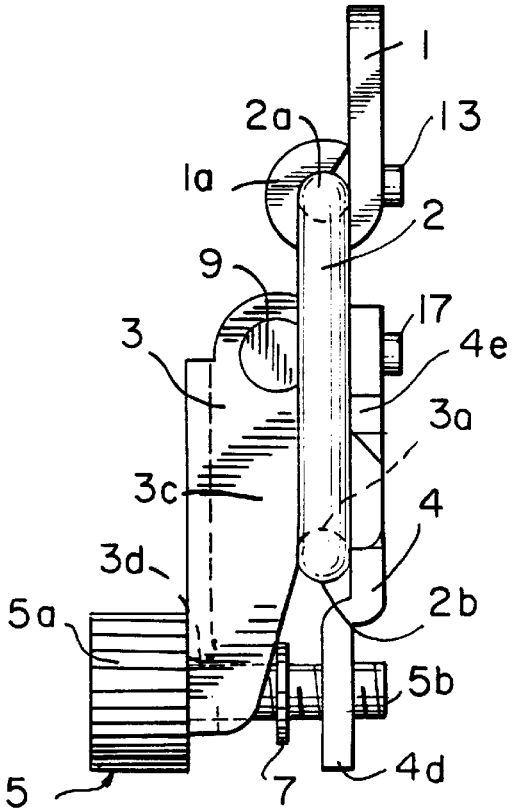
FIG. 14 a right side view of the clamping type lock assembly shown in FIG. 9.
Figure 15:
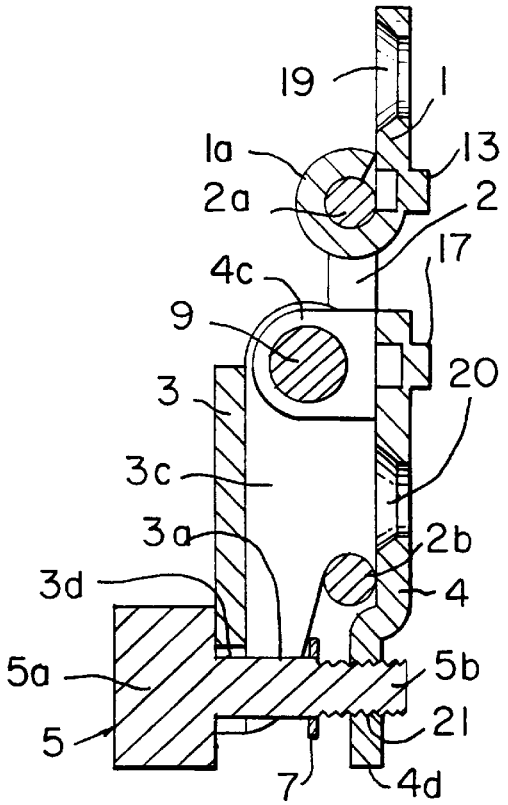
FIG. 15 is a sectional view of the clamping type lock assembly of the present invention, taken along the line 15—15 of FIG. 9.
Figure 16:
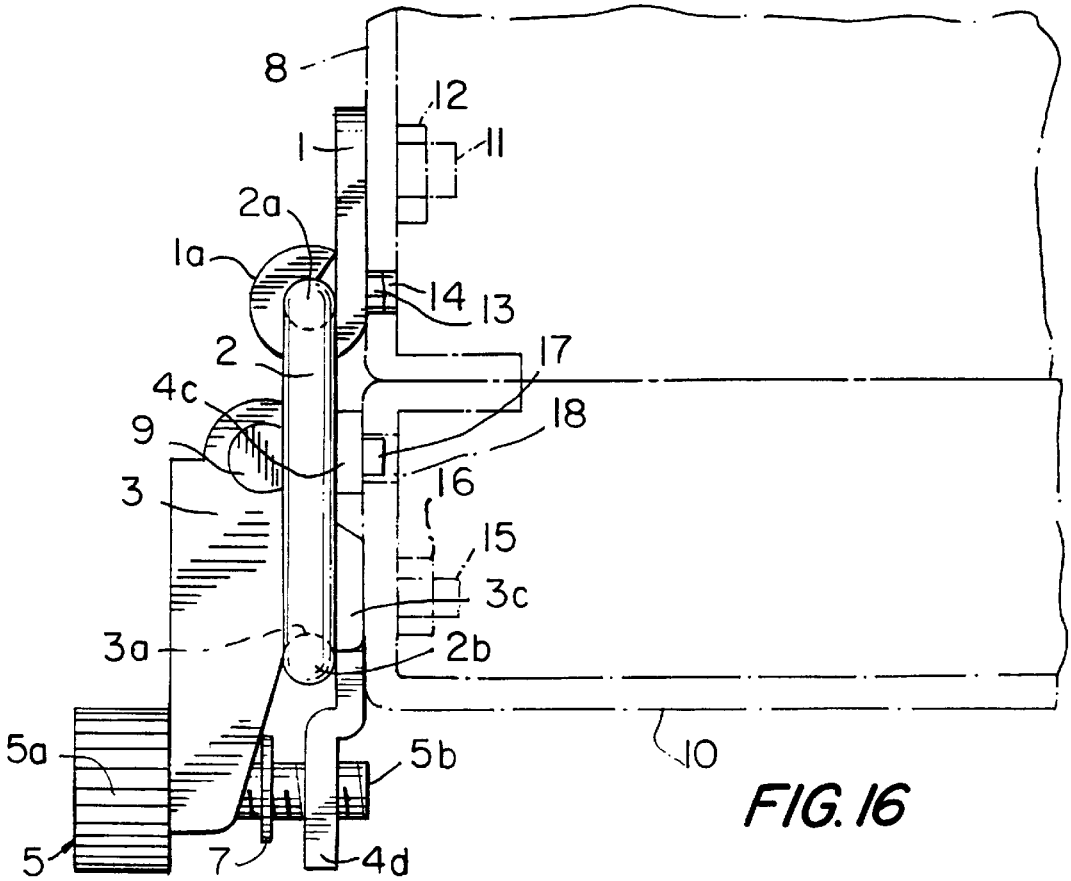
FIG. 16 is a right side view of the clamping type lock assembly shown in FIG. 9 in use.

On the other hand, in the second embodiment of the clamping type lock assembly of the present invention shown in FIGS. 9 to 16, the bearing plate portion 1*a* of the fixed base plate 1 is formed into a sleeve-like shape as is clear from FIG. 15. Provided in a rear surface side of the bearing plate portion 1*a* is a projection 13 which prevents the fixed base plate 1 from rotating on its mounting hole 19. In mounting, the projection 13 of the fixed base plate 1 is inserted into a rotation prevention hole 14 of the first clamped element 8. Then, a screw 11 shown in FIG. 16 is inserted into the mounting hole 19 of the fixed base plate 1 and threadably engaged with a nut 12 disposed in a rear side of the first clamped element 8, so that the fixed base plate 1 is fixedly mounted on the first clamped element 8. As shown in FIG. 12, the fixed seating plate 4 has a pair of its axle-support plate portions 4*c* arranged side by side, and is provided with a rotation prevention projection 17 in its rear surface side, as shown in FIG. 15. The rotation prevention projection 17 of the fixed seating plate 4 is inserted into a rotation prevention hole 18 of the second clamped element 10, as shown in FIG. 16. After that, a screw 15 is inserted into a mounting hole 20 of the fixed seating plate 4 and threadably engaged with a nut 16 disposed in a rear side of the second clamped element 10, so that the fixed seating plate 4 is fixedly mounted on the second clamped element 10. As shown in FIG. 10, the fixed seating plate 4 is provided with a pair of notched narrower portions 4*e* in opposite sides of its main-body portion to receive opposite wall plate portions 3*c* of the operating lever 3 in these notched portions 4*e*, which makes it possible to minimize the entire height of the clamping type lock assembly of the present invention, and, therefore to realize maximum compactness of the lock assembly.

As shown in FIG. 15, a front-end portion 4*d* of the fixed seating plate 4 is provided with the threaded hole 21, and shouldered forward in cross-section so as to enable its threaded hole 21 to be threadably engaged with the fastening bolt 5 by a sufficient length of thread. As is clear from FIG. 9, the receiving hole portion 3*d* of the operating lever 3 is formed into a partially notched circular shape. On the other hand, the fastening bolt 5 has its threaded shaft portion 5*b* fitted in a drop prevention disc 7 for preventing the fastening bolt 5 from dropping out of the operating lever 3. Consequently, even when the threaded shaft portion 5*b* of the fastening bolt 5 is disengaged from the threaded hole 21 of the fixed seating plate 4, there is no fear that the fastening bolt 5 drops out of the operating lever 3 since the drop prevention disc 7 abuts against a rear surface of the front-end portion of the operating lever 3 to prevent the fastening bolt 5 from dropping out of the receiving hole portion 3*d* of the operating lever 3.

In locking operation, the fastening bolt 5 is rotated by a user so as to be fastened to the front surface of the operating lever 3, as shown in FIG. 16, which prevents the operating lever 3 from floating off from the front surface of the second clamped element 10, i.e., prevents the lock assembly from being unlocked even when subjected to vibration in use.

In unlocking operation, the fastening bolt 5 for fixing the operating lever 3 is loosened to permit the operating lever 3 to slidably move, which enables the user to unlock the lock assembly of the present invention.

As described above, in the clamping type lock assembly of the first embodiment of the present invention, in its locked position in which the front-end portion 2*b* of the latch ring 2 engaged with the engaging concave portion 3*a* of the operating lever 3 passes through the locked condition defining reference line (i.e., straight line connecting a cross-sectional center of the base-end portion 2*a* of the latch ring 2 and a cross-sectional center of the axle pin 9) and approaches the fixed seating plate 4, the threaded shaft portion 5*b* of the fastening bolt 5 is inserted into the receiving groove portion 3*b* of the operating lever 3 so that the head portion 6*a* of the fastening bolt 5 is brought into press-contact with a front surface of the front-end portion of the operating lever 3, which prevents the operating lever 3 from floating off from the front surface of the second clamped element 10 even when subjected to vibration, and, therefore maintains the lock assembly of the present invention in its locked position without fail.

On the other hand, in the clamping type lock assembly of the second embodiment of the present invention, in its locked position in which the front-end portion 2*b* of the latch ring 2 engaged with the engaging concave portion 3*a* of the operating lever 3 passes through the locked position defining reference line (i.e., straight line connecting a cross-sectional center of the base-end portion 2*a* of the latch ring 2 and a cross-sectional center of the axle pin 9) and approaches the fixed seating plate 4, the threaded shaft portion 5*b* of the fastening bolt 5 is threadably engaged with the threaded hole 21 of the fixed seating plate 4 so that the head portion 5*a* of the fastening bolt 5 is brought into press-contact with a front surface of the front-end portion of the operating lever 3. Consequently, there is no fear that the operating lever 3 floats off from the front surface of the second clamped element 10 even when subjected to vibration, i.e., there is no fear that the lock assembly of the present invention is accidentally unlocked in use.

What is claimed is:

1. A clamping type lock assembly, comprising:

a fixed base plate (1) fixedly mounted on a first clamped element (8), said fixed base plate (1) being provided with a bearing plate portion (1*a*) in its front surface side;

a fixed seating plate (4) fixedly mounted on a second clamped element (10), said fixed seating plate (4) being provided with an axle-support plate portion (4*c*) in a front surface side of its base-end portion and also being provided with a pin-receiving plate portion (4*a*) in a rear surface side of its front-end portion, said pin-receiving plate portion (4*a*) being provided with a split groove portion (4*b*);

an operating lever (3) having its base-end portion pivoted to said axle-support plate portion (4*c*) of said fixed seating plate (4) through an axle pin (9), said operating lever (3) being provided with an engaging concave portion (3*a*) in a rear surface side of its intermediate portion and also being provided with a receiving groove portion (3*b*) in its front-end portion, said receiving groove portion (3*b*) opening at its front-end side;

a latch ring (2) having its base-end portion (2*a*) pivoted to said bearing plate portion (1*a*) of said fixed base plate (1) and its front-end portion (2*b*) engaged with said engaging concave portion (3*a*) of said operating lever (3);

a fastening pin (6) rotatably inserted in said pin-receiving plate portion (4*a*) of said fixed seating plate (4), said fastening pin (6) being provided with a threaded transverse hole (6*a*) in its intermediate portion; and a fastening bolt (5) provided with a head portion (5*a*) and a threaded shaft portion (5*b*) following said head portion (5*a*), said fastening bolt (5) having said threaded shaft portion (5*b*) slidably inserted in said split groove portion (4*b*) of said fixed seating plate (4), said threaded shaft portion (5*b*) being threadably engaged with said threaded transverse hole (6*a*) of said fastening pin (6);

whereby, in a locked position in which said front-end portion (2*b*) of said latch ring (2) engaged with said engaging concave portion (3*a*) of said operating lever (3) passes through a straight line connecting a cross-sectional center of said base-end portion (2*a*) of said latch ring (2) and a cross-sectional center of said axle pin (9) and approaches said fixed seating plate (4), said threaded shaft portion (5*b*) of said fastening bolt (5) is inserted into said receiving groove portion (3*b*) of said operating lever (3) so that said head portion (5*a*) of said fastening bolt (5) is brought into press-contact with a front surface of said front-end portion of said operating lever (3).

2. A clamping type lock assembly, comprising:

a fixed base plate (1) fixedly mounted on a first clamped element (8), said fixed base plate (1) being provided with a bearing plate portion (1*a*) in its front surface side;

a fixed seating plate (4) fixedly mounted on a second clamped element (10), said fixed seating plate (4) being provided with an axle-support plate portion (4*c*) in a front surface side of its base-end portion and having a pair of notched portions (4*e*) provided on opposite sides of the seating plate main body portion, and also being provided with a threaded hole (21) in its front-end portion (4*d*);

an operating lever (3) having dual opposite side wall portions (3*c*) and having its base-end portion pivoted to said axle-support plate portion (4*c*) of said fixed seating plate (4) through an axle pin (9), said operating lever (3) being provided with an engaging concave portion (3*a*) in a rear surface side of its intermediate portion, and also being provided with a slotted receiving hole portion (3*d*) in its front-end portion;

a latch ring (2) having its base-end portion (2*a*) pivoted to said bearing plate portion (1*a*) of said fixed base plate (1) and its front-end portion (2*b*) engaged with said engaging concave portion (3*a*) of said operating lever (3); and a fastening bolt (5) provided with a head portion (5*a*) and a threaded shaft portion (5*b*) following said head portion (5*a*), said fastening bolt (5) having said threaded shaft portion (5*b*) slidably inserted in said receiving hole portion (3*d*) of said operating lever (3); wherein said seating plate front end portion (4*d*) is shouldered forward towards said operating lever (3) so that an increased length of the fastening bolt threaded shaft portion (5*b*) is engaged with said threaded hole (21);

whereby, in a locked position in which said front-end portion (2*b*) of said latch ring (2) engaged with said engaging concave portion (3*a*) of said operating lever (3) passes through a straight line connecting a cross-sectional center of said base-end portion (2*a*) of said latch ring (2) and a cross-sectional center of said axle pin (9) and approaches said fixed seating plate (4), said dual opposite side wall portions (3*c*) of the operating lever (3) are received in the notched portions (4*e*) of said fixed seating plate (4), and said threaded shaft portion (5*b*) of said fastening bolt (5) is threadably engaged with said threaded hole (21) of said fixed seating plate (4) so that said head portion (5*a*) of said fastening bolt (5) is brought into press contact with a front surface of said front-end portion of said operating lever (3).

3. The clamping type lock assembly of claim 1, wherein said bearing plate portion (1*a*) has a rear side rotation prevention projection (13) which is inserted into a hole (14) of said first clamped element (8), said bearing plate portion (1*a*) being fixedly mounted on said first clamped element (8) and retained by a screw (11) and a nut (12).

4. The clamping type lock assembly of claim 1, wherein said fixed seating plate (4) has a rear side rotation prevention projection (17) which is inserted into a hole (18) of said second clamped element (10), said fixed seating plate (4)

being fixedly mounted on said second clamped element (10) and retained by a screw (15) and a nut (16).

5. The clamping type lock assembly of claim 2, wherein said bearing plate portion **(1*a*) has a single integral rear side rotation prevention projection (13) which is inserted into a hole (14) of said first clamped element (8), said bearing plate portion (1*a*) being fixedly mounted on said first clamped element (8) and retained by a single screw (11) inserted into a mounting hole (19) in the base plate (1) and threadably engaged with a nut (12) so that any rotation of the base plate (1) about the screw (11) relative to the first clamped element (8)** is prevented.

6. The clamping type lock assembly of claim 2, wherein said fixed seating plate (4) has a single integral rear side rotation prevention projection (17) which is inserted into a hole (18) of said second clamped element (10), said fixed seating plate (4) being fixedly mounted on said second clamped element (10) and retained by a single screw (15) inserted into a mounting hole (20) in the seating plate (4) and threadably engaged with a nut (16), so that any rotation of the seating plate (4) about the screw (15) relative to the second clamped element (10) is prevented.

* * * * *